United States Patent [19]

Stocking et al.

[11] Patent Number: 4,534,179

[45] Date of Patent: Aug. 13, 1985

[54] AIR CONDITIONING APPARATUS

[75] Inventors: George E. Stocking; Walter J. Pohl, both of Louisville, Ky.

[73] Assignee: General Electric Company, Louisville, Ky.

[21] Appl. No.: 657,612

[22] Filed: Oct. 4, 1984

[51] Int. Cl.[3] ..... F25D 21/02

[52] U.S. Cl. ..... 62/128; 62/150; 62/160; 62/280; 62/305; 62/324.1

[58] Field of Search ..... 62/125, 128, 150, 160, 62/280, 324.1, 305

[56] References Cited

U.S. PATENT DOCUMENTS

| | | | |
|---|---|---|---|
| 4,037,427 | 7/1977 | Kramer | 62/128 |
| 4,375,752 | 3/1983 | Stocking et al. | 62/150 |
| 4,382,369 | 5/1983 | Stocking | 62/280 |

*Primary Examiner*—Lloyd L. King

*Attorney, Agent, or Firm*—Frank P. Giacalone; Radford M. Reams

[57] ABSTRACT

In a self-contained air conditioner unit of the reversible refrigeration type having cooling and heating cycles, a no-drain heat pump is provided wherein in the heating cycle, water collected on the outdoor heat exchanger operating as the system evaporator is transferred to the indoor section. The condensate is directed into the indoor air flow where it is atomized and directed through the relatively warm indoor heat exchanger operating as a condenser to humidify the air. Control means are provided which produces a signal in the event the condensate when present is not being transferred to the indoor section during the heating cycle.

2 Claims, 3 Drawing Figures

AIR CONDITIONING APPARATUS

BACKGROUND OF THE INVENTION

The present invention relates generally to self-contained air conditioners employing a refrigeration heat pump and more specifically to a condensate disposal system and control therefore of the type disclosed in U.S. Pat. Nos. 4,375,752-Stocking et al and 4,382,369-Stocking, assigned to General Electric Company, the assignee of the present invention.

The air conditioners of this type include a chassis divided between an indoor and outdoor section. The indoor section includes an indoor heat exchanger and a fan for recirculating enclosure air and an outdoor compartment including an outdoor heat exchanger, a fan for circulating outdoor air, the system compressor, and a reversing valve for selectively connecting the compressor to the heat exchanger whereby the outdoor heat exchanger functions as an evaporator during the heating cycle and the indoor heat exchanger functions as the evaporator during the cooling cycle. In the heating cycle, water condensed on the outdoor heat exchanger collects in a sump in the outdoor compartment. The water is lifted out of the sump and directed into the air flow circulating through the indoor section where it atomizes and passes through the relatively warm indoor heat exchanger. A motor driven disc is employed to lift the condensate from the sump area and for directing it into the indoor air stream. The motor is energized only during the heating cycle and only when the outdoor fan is operating.

In the event condensate, when present in the sump, is not directed to the indoor section to be disposed of it may flood out of the chassis as a result in an undesirable flow of water. This situation can occur in the event of motor failure, if the disc is slipping on the motor shaft or if the passageway directing water between the outdoor and indoor section is clogged.

SUMMARY OF THE INVENTION

The present invention relates to an air conditioner of the reversible refrigerator system type wherein in the heating cycle, condensate collected on the outdoor heat exchanger is transferred from a sump area by a condensate disposal system to the indoor section. The condensate is lifted out of the sump area by a rotating disc and directed through a transfer passageway whose outlet is positioned on the indoor section of the unit. The condensate exiting the passageway is atomized and directed through the relatively warm indoor heat exchanger.

By the present invention a moisture sensing control is provided wherein a signal is generated if water present in the sump during the heating cycle is not being transferred to the indoor section.

To this end, a first moisture sensing element is arranged in the sump area to detect the presence of condensate in the sump area. A second moisture sensing element is arranged at the outlet end of the passageway to detect the presence of condensate in the indoor section of the unit. A circuit will be energized giving a signal in the event the outdoor sensing element detects the presence of moisture and the indoor sensing element does not detect the presence of moisture. This is an indication the condensate from the sump is not being transferred to the indoor section to be disposed of and a problem exists.

Accordingly, it is an object of the present invention to provide a control system which will generate a signal if water present in the sump during the heating cycle is not being transferred to the indoor section.

DESCRIPTION OF THE PREFERRED EMBODIMENT

Figure 1:
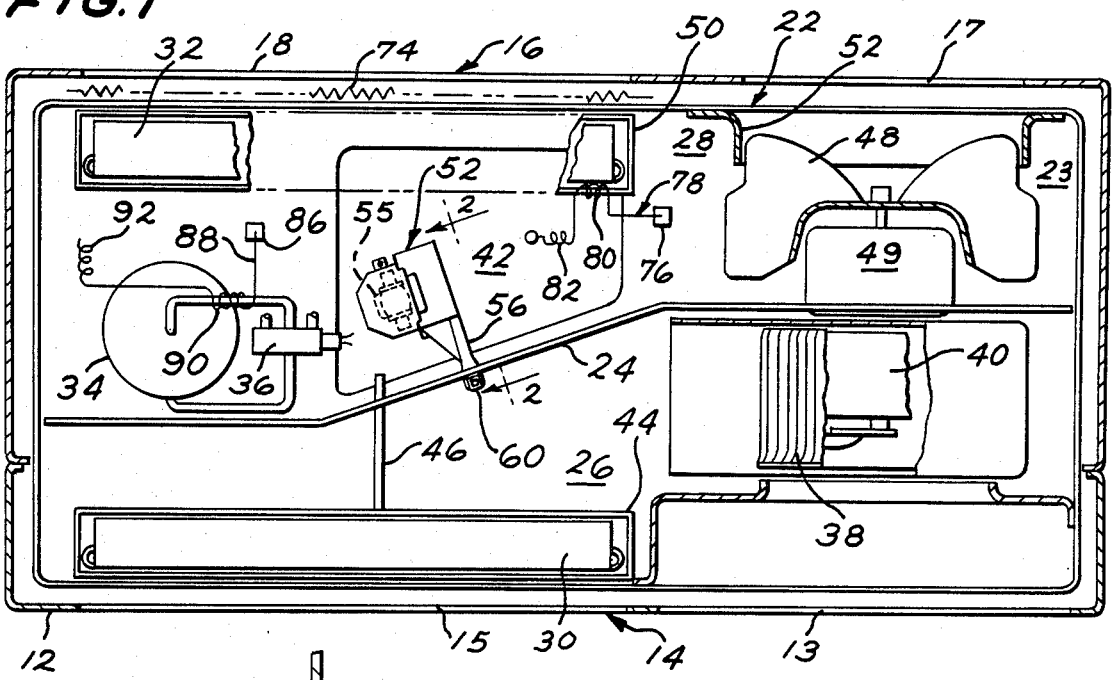
FIG. 1 is a plan view partially in section of an air conditioning unit incorporating a condensate disposal system and control of the present invention.

Referring now to the drawings and initially to FIG. 1 thereof, there is illustrated an air conditioning unit 10 which is arranged to be positioned within an opening of an enclosure. The unit includes a casing or outer sleeve 12 having a front opening 14 including an inlet 13 and an outlet 15 disposed in the enclosure to be conditioned, and a rear opening 16 including an inlet 17 and an outlet 18 exposed to the outdoor ambient. A chassis unit 22 including the refrigerant system and components of the unit is arranged in the sleeve 12. The chassis 22 includes a base 23 that is divided by a partition or barrier 24 into an indoor compartment 26 and an outdoor compartment 28 in which are mounted respectively an indoor heat exchanger 30 and an outdoor heat exchanger 32. The heat exchangers 30 and 32 are connected in refrigerant flow relationship with a compressor 34 also positioned in the outer compartment 28.

In the illustrative embodiment of the invention, the refrigeration system is a heat pump of the reversible refrigerant flow type and is provided with a reversing valve 36. The valve 36 may be selectively operated to reverse the flow of refrigerant to the heat exchanger units 30 and 32 so that they function interchangeably as the evaporator or condenser to heat or cool the respective air streams circulated over the heat exchangers.

When the conditioner is in operation, air is drawn from within the enclosure through inlet 13 and circulated by an air moving means or blower wheel 38. The room air is directed through the indoor compartment 26, passes through the heat exchanger 30, through the outlet 15. The blower 38 is driven by a motor 40 mounted on the inside wall of the barrier 24. During operation of the unit in the cooling cycle the heat exchanger 30 is functioning as the system evaporator and moisture from the air stream being circulated over the heat exchanger 30 is condensed onto its coiled surfaces. Means are provided for collecting this condensate water and delivering it to a water receptacle or sump area 42 formed in the base 23 of the chassis 22 in the outer compartment area 28. More specifically, these means include a suitable drip tray 44 as seen in FIG. 1. Water collected in the tray 44 is delivered to the sump area 42 through a conduit 46 extending from the tray 44 to an open end communicating with the sump 42 in the outer compartment. When the air conditioning unit operates in the cooling cycle the outdoor heat exchanger 32 functions as the system condenser and is cooled by the outdoor air being circulated thereover by a fan 48 driven by the motor 49 mounted on the outside wall of the barrier 24.

When the unit is operating on the heating cycle the reversing valve is positioned to reverse the flow of refrigerant to the heat exchangers 30 and 32, thereupon utilizing the indoor heat exchanger 30 as the system condenser. The outdoor heat exchanger 32, now functioning as the system evaporator, condenses moisture out of the outside air. Condensate from the heat exchanger 32 accumulates in the drip tray 50 and is thereby delivered to the condensate collecting sump 42. As will be explained in detail hereinafter, it is this water collected in the sump area from the outdoor heat exchanger that is transferred to the indoor compartment when the unit is operating in the heating cycle and therein added to the recirculating indoor air.

In the cooling cycle, water collected in the sump 42 from the indoor heat exchanger 30 is disposed in the following manner. Air moving means 48 for circulating air through the outdoor compartment 28 is disposed so that it circulates at least a portion of the air stream in a direction substantially parallel with and over the surface of the water in the sump area 42. More specifically, the air that the fan 48 draws inwardly through the inlet opening 17 and the orifice opening 52 impinges on the barrier 24 and is diverted radially by the fan 48 and barrier 24 into the remaining portion of the outdoor compartment 28. The fan 48 circulates a stream of air along the surface of the water in the sump and this air stream aids in the entrainment of water droplets from the sump 42 into the air stream flowing through the outdoor compartment. The air stream flows through the remaining portions of the outdoor compartment 28 over the heat exchanger 32 and then discharged to the outdoors through an outlet opening 18.

Means operable in the heating cycle are provided for tranferring the condensate water collected in the sump 42 during the heating cycle to the indoor compartaent where the moisture may be added to the indoor air being circulated by the blower 38.

Figure 2:
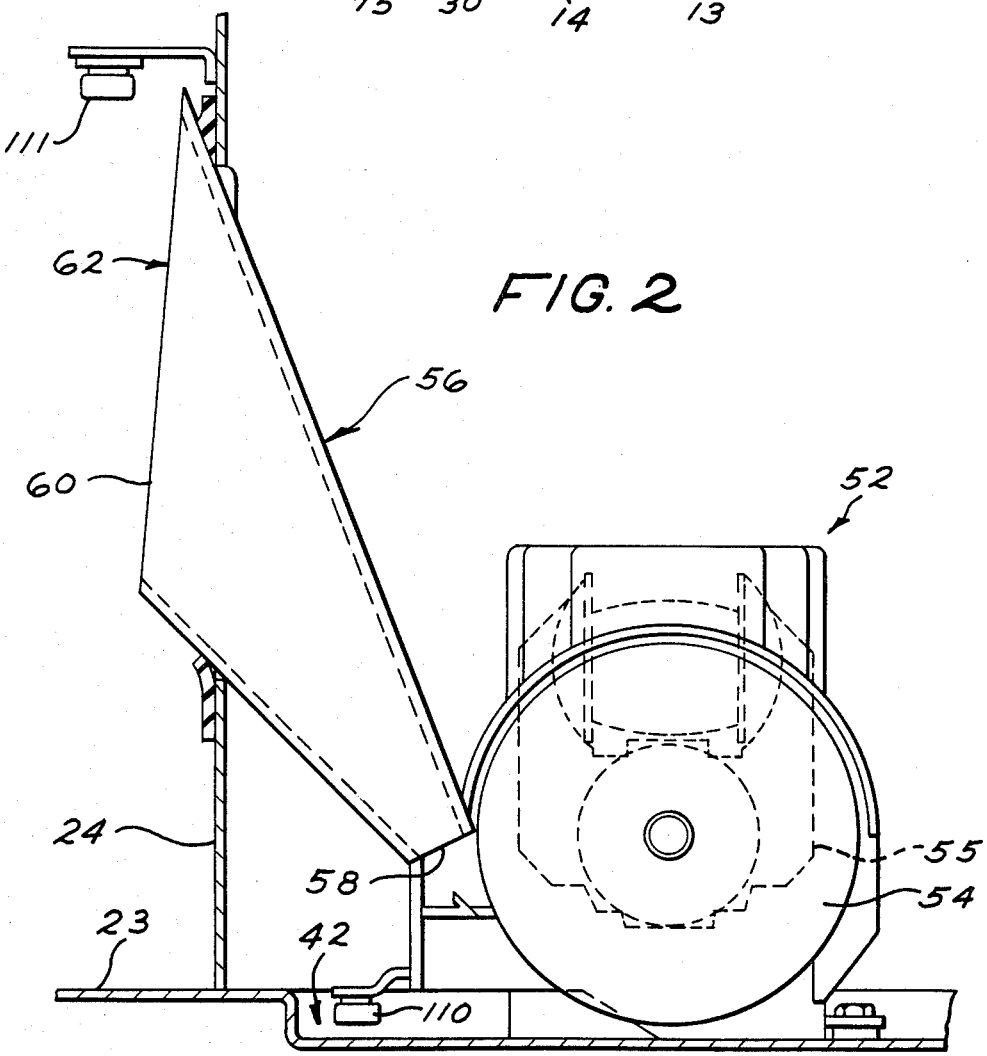
FIG. 2 is a side elevational view taken along line 2—2 of FIG. 1.

In carrying out the disposal of condensate generated when the unit is operating in the heating cycle while at the same time humidifying the indoor air, means are provided for transferring the condensate collected in the outdoor compartment sump area 42 into the air stream being circulated by the blower 38 through the enclosure. The means for tranferring the condensate into the indoor air stream includes a slinger mechanism 52 (FIGS. 1 and 2) arranged in the outdoor chamber 28 which is fully disclosed and described in U.S. Pat. No. 4,382,369-Stocking and U.S. Pat. No. 4,375,752-Stocking et al, both of which are assigned to the General Electric Company, the assignee of the present invention and accordingly will not be explained in full detail. The slinger mechanism 52 is positioned in the sump area 42 generally between the partition 24 and the heat exchanger 32 and in alignment with the indoor heat exchanger 30. As shown in FIG. 2, the slinger mechanism 52 includes a slinger disc 54 driven by a motor 55 and a condensate passageway 56 through which the condensate is transferred to the indoor compartment 26.

As shown in FIG. 2 the lower portion of the disc 54 is positioned in the sump area 42 and will be submerged in condensate when it is present in the sump. The passageway 56 includes an inlet 58 communicating with sump area 42 and an outlet 60 at its other end 62. The end 62 of passageway 56 is arranged in an opening in the barrier 24 so that the outlet 60 is in fact positioned in the indoor compartment 26.

In operation the disc 54 lifts and directs condensate through the passageway 56. Condensate exiting outlet 60 is atomized and carried with the recirculating indoor air when it passes therewith through the indoor heat exchanger. The heat of the indoor heat exchanger 30 functioning as a system condenser is effective in evaporating the moisture as it contacts and passes through the heat exchanger whereupon the vapor and any remaining moisture flows into the recirculating air into the enclosure being conditioned to provide the humidification of the enclosure air. This entrapment of moisture continues so long as the level of condensate water in sump 42 is at or above the lower peripheral edge of disc 54.

Figure 3:
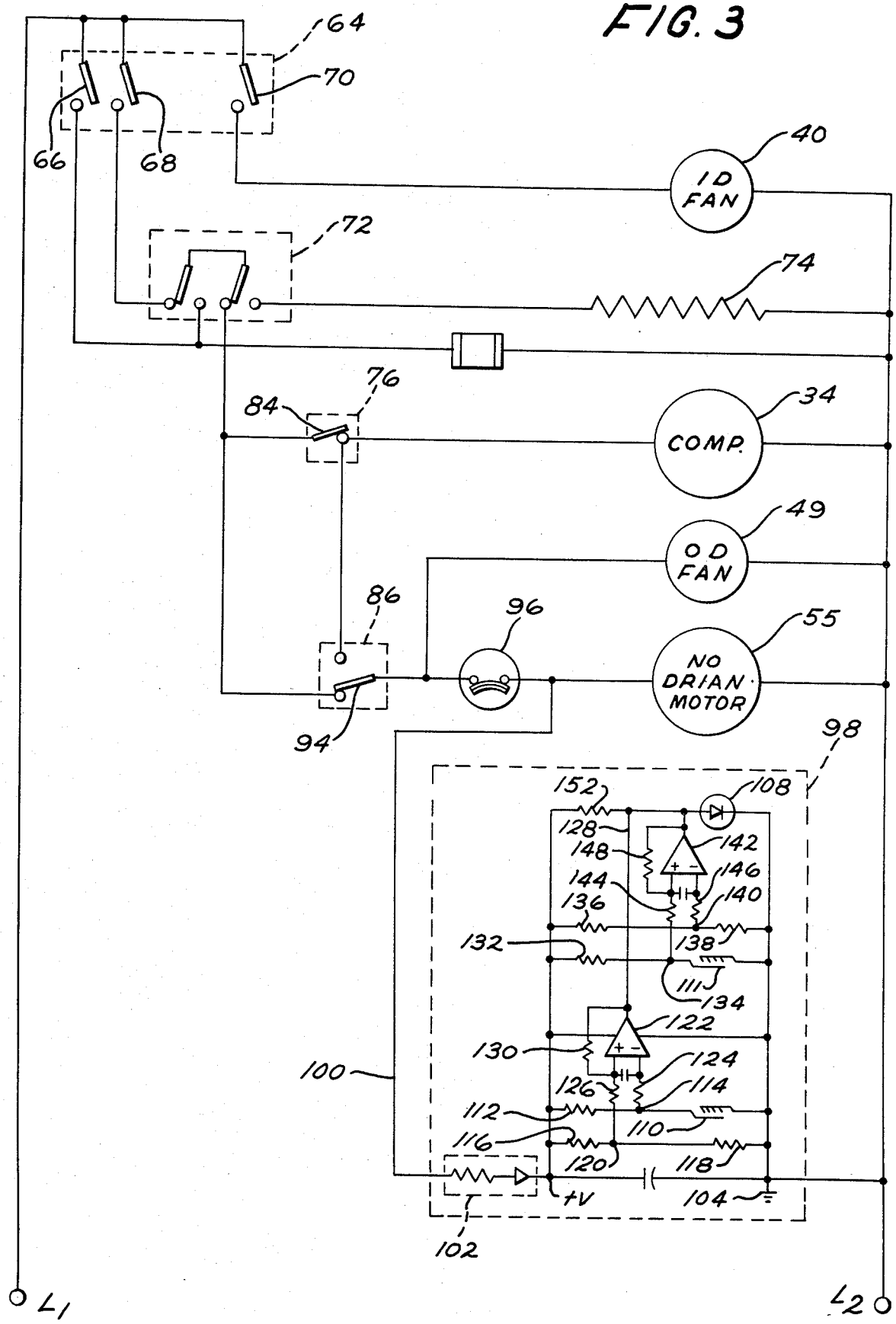
FIG. 3 is a wiring schematic showing a control system incorporating the present invention.

The control system in which the present invention is incorporated is similar to that fully disclosed in the above-mentioned patents and accordingly will not be explained in detail. Referring now to FIG. 3, the control circuit includes the customary mode selection switch 64 having a heating cycle switch 66, a cooling cycle switch 68, and an indoor fan speed selective switch 70. A two-stage thermostat 72 is employed to maintain the enclosure temperature at a selected level in both heating and cooling. When the system functions through the second stage thermostat 72 a circuit is completed through an auxiliary heater 74 that provides heat when the compressor is de-energized due to a frost condition. The switch-over or reversing valve 36 is controlled by a relay 37 energized when the heating switch 66 is closed. The control system further includes a first thermostat 76 including a sensing element 78 having one portion 80(FIG. 1) exposed to the surface temperature of the outdoor heat exchanger 32 and another portion 82 exposed to the sump drain area 42. The first thermostat 76 includes a switch 84 operable by the sensing element 78 that is effective to de-energize the compressor 34 when either of the portions 80, 82 of element 78 senses a preselected frosting temperature. A second thermostat 86 includes a sensing element 88 (FIG. 1) having one portion 90 exposed to refrigerant line temperature adjacent the reversing valve 36 and another portion 92 exposed to the ambient outdoor temperature. The second thermostat 86 includes a switch 94 operable by the sensing element 88 when either of the portions 90 or 92 senses a preselected frosting temperature to control operation of the outdoor fan 49. The circuit to the slinger mechanism motor 55 is in parallel to the outdoor fan 49 and in series with the thermostat switch 94. Accordingly, motor 55 is energized only when the fan 49 is allowed to operate through switch 94. Since thermostat switch 94 precludes operation of fan 49 during frosting temperature conditions, it also prevents operation of motor 55 during those sensed frost conditions. To prevent operation of the motor 55 during the cooling cycle a bi-metallic thermostat switch 96 is arranged in series with the motor 55. The switch 96 is positioned in heat exchange relationship with a portion of the refrigerant system between the outdoor heat exchanger 32 and the reversing valve 36. In the cooling cycle when the outdoor heat exchanger 32 is functioning as a system condenser, the switch 96 will sense the relatively warm temperature of the refrigerant being discharged from the compressor and open to prevent energization of the motor 55. This will prevent condensate collecting in the sump from the indoor heat exchanger during the cooling cycle from being sprayed back into the indoor section.

Up to this point, the description of the control system employed in controlling operation of the air conditioning unit has been similar to that described in the above mentioned U.S. Pat. No. 4,375,752. The present invention is directed to the provision of an improved circuit adapted to the air conditioner described above wherein a signal is generated in the event condensate, when present in the sump during the heating cycle, is not being transferred to the indoor compartment in the manner described above. This situation may occur for several reasons; for example, the motor 55 may malfunction or stall because the disc 54 is bound, or the thermostat switch 96 may not close. If the accumulating condensate is not transferred and evaporated into the circulating indoor air as described above, by the present invention means are provided to signal the user of the air conditioner of this condition.

By the present invention means are provided for producing a signal when the slinger mechanism is not functioning properly. To this end an electronic moisture sensing control circuitry 98 operating at relatively low voltages is provided. The moisture sensor circuit 98 shown in FIG. 3 will effectively carry out the purposes of the invention. It should be noted, however, that other circuit configurations may be employed in providing the appropriate signal. The moisture sensing control circuit is connected to the control circuit so as to be in parallel with the slinger mechanism motor 55. Accordingly, the moisture control circuit is energized only when current is supplied to the motor 55. To this end, the moisture sensing control circuit 98 is connected at line 100 between thermostat switch 96 and the motor 55 and line L2. The moisture sensing control circuit 98 of the present embodiment includes a conventional low voltage power supply 102 operating from the supply lines 100 and L2 and provide an output voltage between +V terminals and the circuit ground 104. The circuit 98 includes an outdoor moisture sensor 110 positioned so as to be in communication with the outlet end 60 of the passageway 56 leading from the rotating disc 54 and an indoor moisture sensor 111 arranged in the sump 42. The moisture sensing circuit 98 is such that a signal LED 108 will light in the event the outdoor sensor 110 senses the presence of water in the sump 42 and indoor sensor 111 does not sense the presence of water exiting the passageway. This condition indicates a malfunction and the LED 108 will be energized, giving a visual signal. It should be noted that any number of commercially available sensors may be employed in carrying out the present invention; for example, Model #CGS-H11 Humidity Sensor, sold by Chichibu Cement Co., Ltd, may be used.

Referring now to FIG. 3, the circuit 98 includes the outdoor moisture sensor 110 and a fixed resistor 112 connected in series between +V and the circuit ground 104 to provide a humidity dependent voltage at a node 114, and a reference voltage divider comprising fixed resistors 116 and 118 connected in series between +V and circuit ground 104 to provide a fixed reference voltage at a node 120. The indoor sensor 111 is physically located so as to respond to the moisture content of the air exiting the passageway leading from the disc 54 and is essentially the same as sensor 110 located in the sump 42.

With reference to the outdoor sensor 110 which detects the presence of water in the sump 42, the nodes 114 and 120 are connected to a comparator 122 through respective input resistors 124 and 126. The node 114 supplying the humidity dependent voltage is connected to the comparator 122 inverting (−) input and the node 120 supplying the fixed reference voltage is connected to the comparator 122 non-inverting (+) input such that as sensed moisture increases and the resistance of the sensor 110 decreases, the voltage applied to the inverting (−) input decreases until it is less than the fixed reference voltage applied to the non-inverting (+) input, whereupon the comparator 122 output line 128 goes high. To provide a slight degree of hysteresis a positive feedback resistor 130 is connected between the comparator 122 and the non-inverting (+) input.

The indoor moisture sensor 111 which detects the presence of water exiting outlet 60 and a fixed resistor 132 are connected in series between the +V and the circuit ground 104 to provide a moisture dependent voltage at the node 134 and a reference voltage divider comprising fixed resistors 136 and 138 connected in series between +V and circuit ground 104 to provide a fixed reference voltage at a node 140. The nodes 134 and 140 are connected to a comparator 142 through respective input resistors 144 and 146. The node 134 supplying the moisture dependent voltage is connected to the comparator 142 non-inverting (+) input and the node 140 supplying the fixed reference voltage is connected to the comparator 142 inverting (−) input such that, as the sensed moisture decreases and the resistance of sensor 111 increases, the voltage applied to the non-inverting (+) input increases until it is more than the fixed reference voltage applied to the inverting (−) input, whereupon the comparator 142 output line goes high. To provide a slight degree of hysteresis a positive feedback resistor 148 is connected between the comparator 142 and the non-inverting (+) input.

Since the comparator outputs are connected, in the event that one comparator output is low and the other one is high, the low output sink effect will overcome the pull up resistor 152, and the output will be low, so that the LED will not light. Therefore, the LED lamp can light only if both comparator outputs are high; i.e., if comparator 122 detects moisture and comparactor 142 detects the absence of moisture.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. A self-contained refrigeration heat pump air conditioning unit operable in a heating and cooling cycle for conditioning the air of an enclosure comprising:

a chassis including a base member and a barrier dividing said chassis into an indoor compartment and an outdoor compartment;

indoor and outdoor heat exchangers mounted respectively in said indoor and outdoor compartments;

an indoor air moving means for recirculating enclosure air through said indoor compartment;

an outdoor air moving means for circulating air through said outdoor compartment;

a compressor mounted in said outdoor compartment;

means for selectively connecting said compressor to said heat exchangers whereby said outdoor heat exchanger functions as an evaporator during operation of the unit on the heating cycle and said indoor heat exchanger functions as an evaporator during the cooling cycle;

a condensate collection sump in said outdoor compartment formed in said base member;

means for directing condensate formed on said indoor and outdoor heat exchangers into said sump;

condensate disposal means arranged in said outdoor compartment including a housing, passageway means connected to said housing at one end and having an outlet at the other end positioned in an opening in said barrier so as to communicate with the indoor compartment, condensate lifting means arranged on said housing operable in the heating cycle for lifting condensate from said sump and directing it through said passageway in said indoor compartment into the path of air being circulated by said indoor fan where it is vaporized and directed through the relatively warm indoor heat exchanger functioning as a condenser in said heating cycle; and control means rendering said condensate lifting means operable in said heating cycle including circuit means producing a signal when condensate present in said sump is not being transferred through said passageway to said indoor compartment.

2. The invention recited in claim 1 wherein said control means further includes;

a first moisture sensing means arranged in said sump;

a second moisture sensing means arranged at the indoor outlet end of said passageway;

circuit means connecting said sensors including signal means being energized when said first moisture sensing means senses the presence of moisture in said sump and said second moisture sensing means senses the absence of moisture at said outlet end of said passageway.

* * * * *